US006667096B2

(12) United States Patent
Wandel et al.

(10) Patent No.: US 6,667,096 B2
(45) Date of Patent: Dec. 23, 2003

(54) METHOD OF SPINNING, SPOOLING, AND STRETCH TEXTURING POLYESTER FILAMENTS AND POLYESTER FILAMENTS PRODUCED

(75) Inventors: Dietmar Wandel, Hanau (DE); Achim Dulling, Köln (DE); Ulrich Mirwaldt, Maintal (DE); Alexander Klein, Ingelheim (DE)

(73) Assignee: Zimmer A.G., Frankfurt am Main (DE)

( * ) Notice: Subject to any disclaimer, the term of this patent is extended or adjusted under 35 U.S.C. 154(b) by 0 days.

(21) Appl. No.: 10/179,665

(22) Filed: Jun. 25, 2002

(65) Prior Publication Data

US 2002/0195740 A1 Dec. 26, 2002

Related U.S. Application Data

(63) Continuation-in-part of application No. 10/000,290, filed on Nov. 2, 2001.

(60) Provisional application No. 60/263,013, filed on Jan. 19, 2001.

(30) Foreign Application Priority Data

Nov. 3, 2000 (DE) ..... 100 54 422

(51) Int. Cl.[7] ..... D02G 3/00; D01D 5/16

(52) U.S. Cl. ..... 428/364; 264/210.2; 264/210.3; 264/210.5; 264/210.6; 264/210.8; 264/211

(58) Field of Search ..... 264/210.2, 210.3, 264/210.5, 210.6, 210.8, 211; 428/364

(56) References Cited

U.S. PATENT DOCUMENTS 3,975,488 A 8/1976 Patterson

FOREIGN PATENT DOCUMENTS

| | | |
|---|---|---|
| EP | 1033422 | 9/2000 |
| JP | 2001020136 | 1/2001 |
| WO | 0166836 | 9/2000 |

*Primary Examiner*—Samuel A. Acquah
(74) *Attorney, Agent, or Firm*—McDonnell Boehnen Hulbert & Berghoff

(57) ABSTRACT

The present invention relates to a process for the production and for the spooling of preoriented polyester filaments comprising at least 90 weight %, relative to the total weight of the polyester filament, of polybutylene terephthalate (PBT) and/or polytrimethylene terephthalate (PTMT), preferably of PTMT, characterized in that:

a) the spinline extension ratio is set in the range of 70 to 500;

b) the filaments, immediately after exiting from the spinning nozzles, pass through a cooling delay zone from 30 mm to 200 mm in length;

c) the filaments are cooled off to below the solidification temperature;

d) the filaments are bundled at a distance of between 500 mm and 2500 mm from the lower side of the spinneret plate;

e) the tension of the thread in front of and between the draw-off galettes is set to between 0.05 cN/dtex to 0.20 cN/dtex;

f) the thread is spooled with a tension of the thread of between 0.025 cN/dtex to 0.15 cN/dtex;

g) the spooling speed is adjusted to between 2200 m/min. and 3500 m/min.

11 Claims, 2 Drawing Sheets

METHOD OF SPINNING, SPOOLING, AND STRETCH TEXTURING POLYESTER FILAMENTS AND POLYESTER FILAMENTS PRODUCED

This is a continuation-in-part of U.S. patent application Ser. No. 10/000,290, filed Nov. 2, 2001 which claims the benefit of U.S. Provisional Patent Application Ser. No. 60/263,013, filed Jan. 19, 2001.

BACKGROUND OF THE INVENTION

1. Field of the Invention

The present invention relates to a process for the spinning and spooling of preoriented polyester filaments comprising polybutylene terephthalate (PBT) and/or polytrimethylene terephthalate (PTMT) (preferably of PTMT) in an amount of at least 90 weight % relative to the total weight of the polyester filament. The present invention also relates to and comprises preoriented polyester filaments that can be obtained by means of the process. In addition, the present invention relates to a process for the stretch texturing of the spun and spooled polyester filaments, as well as the bulky polyester filaments that can be obtained by means of stretch texturing.

2. Summary of the Related Art

The production of continuous polyester filaments, particularly polyethylene terephthalate (PET) filaments, in a two-stage process, is known in the art. In these processes, flat, preoriented filaments are spun and spooled during a first stage and subsequently, during a second stage, stretched into finished form and thermofixed, or else stretch-textured into bulky filaments.

"Synthetic Fibers" (F. Fourné (1995), published by Hanser-Verlag, Munich) provides an overview of this. Only the production of PET fibers is described there, and no closed spinning technology is explained. Rather, only an overview of the general characteristics are described.

The technical production of various spinable polymers, such as polypropylene, polyamides, polyesters, etc., among others, is the object of application DE-OS 38 19 913. Only the production of PET fibers is described in the examples, as these can be obtained at the temperature at which the polymer is processed.

A problem in the production of continuous polytrimethylene terephthalate (PTMT) or polybutylene terephthalate (PBT) filaments is that preoriented filaments have a considerable tendency to shrink during storage at ambient temperature, both immediately after spinning and upon spooling, as well as several hours after the spooling, leading to shortening of the fibers. The bobbin is thereby compressed so that, in the extreme case, a tight shrinking of the bobbin on the spooling chuck can arise, and the bobbin can no longer be removed. Furthermore, a so-called "saddle" with hard edges and an indented middle is formed in the bobbin. Consequently, the characteristic textile values of the filaments, such as the uster, for example, become unevenly stronger, and there are unspooling problems during the processing of the bobbins. Only the limitation of the weight of the bobbin to less than 4 kg provides remedies this. Such problems do not appear during the processing of PET fibers.

Furthermore, it has been observed that, in contrast to PET filament, preoriented PBT- or PTMT filaments age to an increased degree during storage. A structural hardening appears, which leads to such a great reduction in filament shrinkage that a subsequent crystallization can be observed.

Such types of PBT and PTMT filaments are only conditionally suitable for further processing as they lead to errors in stretch texturing as well as to a significant reduction of tenacity of the textured thread. The reduction of the texturing speed or of the stretching ratio is the result.

These differences between PET and PBT or PTMT are attributable to structural differences and differences in characteristics such as are presented, for example, in Chemical Fibers Int., page 53, volume 50 (2000) and that were the theme of the 39th Int. Man-Made Fibers Congress, from Sep. 13 to 15, 2000, in Dornbirn. It is assumed that different chain formations are responsible for the differences in characteristics.

First attempts at the solution of these problems are described in WO 99/27168 and EP 0 731 196 B1. WO 99/27618 discloses a polyester fiber consisting of at least 90 weight % polytrimethylene terephthalate and has a boiling-water shrinkage of between 5%, and 16%, as well as an elongation of 20% to 60%. The production of polyester fibers described in WO 99/27168 is carried out by means of spinning and stretching. In this, spinning speeds of a maximum of 2100 m/min. are stated. The process is uneconomical because of the low spinning speed. Furthermore, the polyester fibers that are obtained are, as the indicated characteristic parameters show, strongly crystalline and are, as a result, only suitable for stretch texturing processes to a limited extent.

EP 0 731 196 B1 claims a process for spinning, stretching, and spooling synthetic thread in which the thread is, after the stretching but before the spooling, subjected to heat treatment to reduce the tendency to shrink. Usable synthetic fibers also include polytrimethylene terephthalate fibers. In accordance with EP 0 731 196 B1, the heat treatment is applied as the synthetic thread is guided closely—but essentially without contact—along a longitudinally extended heating surface. The heat treatment makes the process more expensive and additionally results in synthetic threads having high crystallinity that are for stretch texturing to a limited extent.

The stretch texturing of preoriented polytrimethylene terephthalate filaments at texturing speeds of 450 m/min. and 850 m/min. is described in the article by Dr. H. S. Brown and H. H. Chuah, "Texturing of textile filament yarns based on polytrimethylene terephthalate", in Chemical Fibers International, Volume 47, Feb. 1997, pages 72–74. According to this disclosure, the lower texturing speed of 450 m/min. is better suited for polytrimethylene terephthalate filaments, since fibers with better material characteristics are obtained in this case. The tenacity of the polytrimethylene terephthalate fibers is reported to be 26.5 cN/tex (texturing speed of 450 m/min.) or 29.15 cN/tex (texturing speed of 850 m/min.), respectively, and the elongation 38.0% (texturing speed of 450 m/min.) or 33.5% (texturing speed of 850 m/min.), respectively.

WO 01/04393 describes PTMT filaments that have a shrinkage in the range of 3 to 40%. This value was determined immediately after the production of the filaments, however. As FIG. 1 of the present specification shows, this value drops to below 20% under normal conditions after a storage time of 4 weeks.

Shrinkage is a measure of the processability and the degree of crystallization of the fibers. The fibers described in WO 01/04393 have a higher degree of crystallization, resulting in significantly worse processing and only at lower stretching ratios and/or texturing speeds.

SUMMARY OF THE INVENTION

The present invention provides a simplified process for spinning and spooling preoriented polyester filaments comprising (by at least 90 weight % relative to the total weight of the filaments) PBT and/or PTMT. The preoriented polyester filaments made according to the method of the invention have values of elongation at break in the range of 90% to 165%, high uniformity of the filament characteristic values, and a low degree of crystallization.

The process of the invention also can be conducted on large scale and economically. The process in accordance with the invention permits the highest possible spinning speeds, preferably greater than 2200 m/min., and high thread weights (of more than 4 kg) of the bobbin.

The present invention also improves the storability of the preoriented polyester filaments obtained by means of the process of the invention. Filaments made according to the process of the invention can be stored for a longer period of time, such as 4 weeks. Compression of the bobbin during storage, particularly tight shrinking of the bobbin onto the spooling chuck, as well as the formation of a saddle with hard edges and indented middle part, is prevented, to the extent possible, so that problems of unspooling during the further processing of the bobbins is eliminated.

In accordance with the invention, the preoriented polyester filaments can be further processed, in a simple way, in a stretch or stretch texturing process, particularly at high texturing speeds, preferably greater than 450 m/min. The filaments obtained by means of stretch texturing have outstanding material characteristics, such as a high tenacity at break of more than 26 cN/tex, as well as high elongation at break of more than 30% in the case of HE-filaments, or more than 36% for SET filaments, respectively.

All patents, patent applications, and other publications recited herein are incorporated by reference in their entirety. In the event of an inconsistency between the present disclosure and the disclosures incorporated by reference, the present disclosure is relied upon herein.

DETAILED DESCRIPTION OF THE INVENTION

Figure 1:
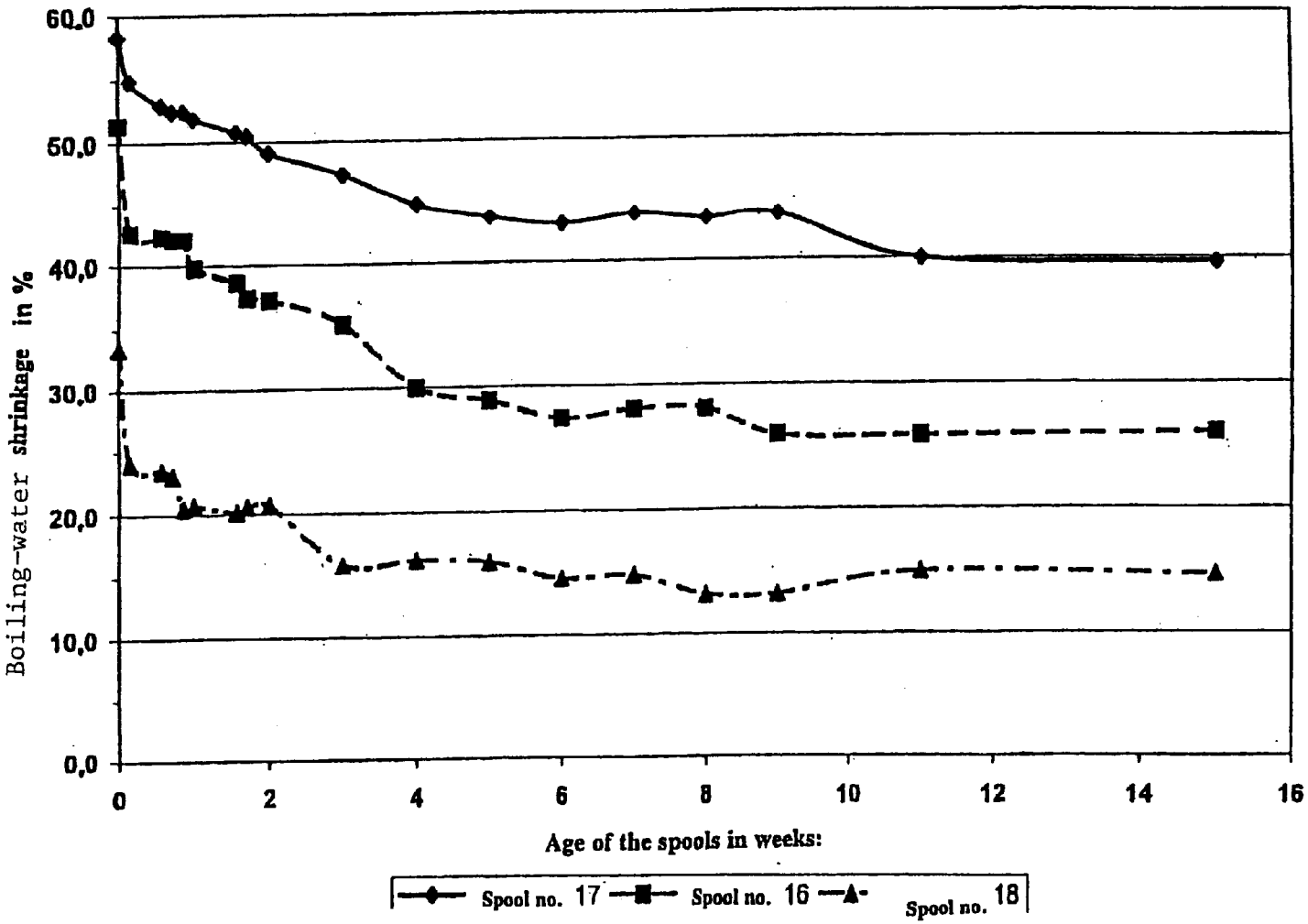
FIG. 1 describes the change of the boiling-water shrinkage for three PTMT-POY bobbins in dependence on the storage time under normal climate conditions. In this, the change of the POY shrinkage was investigated for three bobbins with different starting values over the storage time at normal climate conditions. Spools no. 16 and 17, with a high initial value >40%, show, after 4 weeks, a shrinkage above 30%, preferably above 40%. In the event that the initial value of the shrinkage is lower than 40%, however, then bobbin 18 shows that this drops below the critical value of 30% after 4 weeks of storage time.

According to the invention, in a process for the production and for the spooling of preoriented polyester filaments that consists of at least 90 weight % (relative to the total weight of the polyester filaments) of polybutylene terephthalate (PBT) and/or polytrimethylene terephthalate (PTMT), preferably of PTMT:

a) the spinline extension ratio is set in the range of 70 to 500;

b) the filaments, immediately after exiting from the spinning nozzles, pass through a cooling delay zone of from 30 mm to 200 mm in length;

c) the filaments are cooled off to below the solidification temperature;

d) the filaments are bundled at a distance of between 500 mm and 2500 mm from the lower side of the spinneret plate;

e) the tension of the thread in front of and between the draw-off galettes is set to between 0.05 cN/dtex to 0.20 cN/dtex (preferably to 0.15 cN/dtex);

f) the thread is spooled with a thread tension of between 0.025 cN/dtex to 0.15 cN/dtex; and g) the spooling speed is adjusted to between 2200 m/min. and 3500 m/min.;

we have been able, in a manner that was simply not foreseeable, to make available polyester filaments that have proven their outstanding material characteristics, even after a storage for 4 weeks under normal conditions. No significant worsening of the uniformity values of the thread as the result of an aging or a shrinking of the bobbin of the spun fiber is observed.

The process of the invention also possesses a number of additional advantages. These include, among others, the following:

i) the ability to conduct the process in a simple way and manner, on a large technical scale, and economically. In particular, the process permits spinning and spooling at high spooling speeds (of at least 2200 m/min.) as well as the production of high thread weights of the bobbins of more than 4 kg.

ii) spin additives can be omitted, leading to the production of polyester filaments in a particularly economic manner.

iii) The preoriented polyester filaments obtained by means of the process of the invention consequently can be further processed in a simple way and manner, on a large technical scale, and in an economical manner, in either a stretching or a stretch texturing process. The texturing thereby can be conducted at speeds of greater than 450 m/min.

iv) Because of the high uniformity of the preoriented polyester filaments obtained by the process of the invention, it is possible to provide a good bobbin shape, in a simple way and manner, which makes possible uniform and nearly error-free dyeability and further processing of the preoriented polyester filaments.

v) The filaments of the invention obtained by stretch texturing have high tenacity at break (greater than 26 cN/tex) as well as high elongation at break (greater than 30% for HE filaments, or more than 36% for SET filaments).

The present invention further comprises a process for production and spooling of preoriented polyester filaments that are at least by 90 weight % (relative to the total weight of the polyester filament) of polybutylene terephthalate (PBT) and/or polytrimethylene terephthalate (PTMT). Polybutylene terephthalate (PBT) and/or polytrimethylene terephthalate (PTMT) are known to those of ordinary skill in the art. Polybutylene terephthalate (PBT) can be obtained by polycondensation of terephthalic acid with equimolar quantities of 1,4-butanediol, while polytrimethylene terephthalate can be obtained by polycondensation of terephthalic acid with equimolar quantities of 1,3-propanediol. Mixtures of both polyesters are also within the scope of the invention. In accordance with the invention, PTMT is preferred.

The polyesters of the invention can be either homo- or co-polymers. Preferred are copolymers containing, in addition to recurring PTMT and/or PBT units, up to 15 mol. %

(relative to all repetition units of the polyester) of monomers of normal co-monomers, such as ethylene glycol, diethylene glycol, triethylene glycol, 1,4-cyclohexanedimethanol, polyethylene glycol, isopthalic acid, and/or adipinic acid, for example. Within the framework of the present invention, however, polyester homopolymers are preferred.

Polyesters in accordance with the invention can contain normal quantities of additional additive substances as admixtures, such as catalysts, stabilizers, antistatic agents, antioxidants, flame retarding agents, colorants, colorant absorption modifiers, light stabilizers, organic phosphites, optical brighteners, and matting agents. The polyesters preferably contain from 0 to 5 weight % of additives, relative to the total weight of the filament.

Furthermore, the polyesters can also contain a slight amount of branching components, preferably up to 0.5 weight % relative to the total weight of the filament. The branching components that are preferred in accordance with the invention include, among others, polyfunctional acids, such as trimellitic acid, pyromellitic acid, or tri- to hexavalent alcohols, such as trimethylolpropane, pentaerythrite, dipentaerythrite, glycerin, or corresponding hydroxy acids.

The polyesters that are usable in the sense of the invention are, preferably, thermoplastically formable and can be spun and spooled into filaments. Polyesters that have intrinsic viscosity in the range of from 0.70 dl/g to 0.95 dl/g are particularly advantageous.

In the process according to the invention, the melt or mixture of melts of the polyester is pressed into spin packs by means of a spinning pump at constant rotational speed in which the rotational speed is adjusted in accordance with known computation formula in such a manner that the desired thread titer is achieved. The polyester melt is then extruded through the nozzle apertures of the spinneret plate of the spin pack assembly into molten filaments.

The melt can be produced from polymer chips in an extruder, for example, whereby it is particularly favorable to dry the chips in advance to a water content of ≦30 ppm, particularly to a water content of ≦15 ppm.

The temperature of the melt (generally defined as the spinning temperature and measured in the melt before entering the spinning pump) depends upon the melting point of polymer or mixture of polymers used. It preferably lies in the range given Formula 1:

$$T_m+15^\circ\text{ C.} \leqq T_{Sp} \leqq T_m+45^\circ\text{ C.} \qquad \text{Formula 1;}$$

wherein $T_m$ is the melting point of the polyester [° C]; and $T_{Sp}$ is the spinning temperature [° C].

The specified parameters limit the hydrolytic and/or thermal viscosity reduction, which should preferably be as low as possible. Within the framework of the present invention, a viscosity reduction of less than 0.12 dl/g, particularly less than 0.08 dl/g, is highly desirable.

Melt homogeneity has a direct influence on spun filaments' materials characteristics. It is thus preferable to use a static mixer with at least one element for the homogenization of the melt installed after the spinning pump.

The temperature of the spinneret plate, which is dependent upon the spinning temperature, is controlled by means of so-called associated heating. A heating vessel heated with "Diphyl", or with additional convection- or radiation heaters, for example, can be employed in associated heating. The temperature of the spinneret plates is usually around the spinning temperature.

Increased temperature of the spinneret plate can be achieved through pressure drop in the spin pack assembly. Known derivations, such as, for example, that by K. Riggert, "Progress in the production of polyester tire cord thread", in Chemistry Fibers, 21, page 379 (1971), describe a temperature increase of approximately 4° C. per 100 bar of pressure drop.

It is additionally possible to control the spin pack pressure through the application of loose filter media, particularly steel sand with an average grain size of between 0.10 mm and 1.2 mm, preferably between 0.12 mm and 0.75 mm, and/or filters with a pore size of ≦40 μm that can be produced from metal screens or non wovens.

In addition, the drop of pressure in the nozzle aperture contributes to the overall pressure. The overall spin pack pressure is preferably set between 80 bar and 450 bar, particularly between 100 bar and 250 bar.

The spinline extension ratio $i_{Sp}$—i.e., the quotient of the draw-off speed and the capillary extrusion speed—is computed in accordance with U.S. Pat. No. 5,250,245 by means of Formula 2, with the density of the polymer or mixture of polymers, the diameter of the nozzle aperture, and the titer of the individual filament:

$$i_{Sp}=2.25\cdot 10^5\cdot(\delta\cdot\pi)\cdot D^2(\text{cm})/\text{dpf(den)}; \qquad \text{Formula 2;}$$

in which:

δ: Density of the melt [g/cm$^3$]; for PTMT=1.12 g/cm$^3$;

D: Diameter of the nozzle aperture [cm]; and dpf: Titer of the individual filament [den].

Within the framework of the present invention, the spinline extension ratio is between 70 and 500, preferably between 100 and 250.

The length/diameter ratio of the nozzle aperture is preferably selected from between 1.5 and 6, especially between 1.5 and 4.

The extruded filaments pass through a cooling delay zone directly below spin pack assembly. This is configured as a recess zone, inside which the filaments exiting from the nozzle apertures are protected against the direct effect of the cooling gas and are delayed for drawing-off or for cooling. An active portion of the quench delay is provided in the form of an off-set of the spin pack assembly into the spinning heating vessel (beam), so that the filaments are surrounded by heated partitions. A passive portions is formed of insulation layers and unheated framework. The length of the active recess is between 0 to 100 mm and those of the passive portion between 20 to 120 mm, whereby a total length of 30 to 200 mm, preferably 30 to 120 mm, is set.

As an alternative to an active recess, a heated tube can be attached below the spinning beam. In contrast to the active recess, heating of this zone (with cylindrical or rectangular cross-section) is independent of the spinning beam heating.

In radial, porous, cooling systems concentrically surrounding the thread, the cooling delay can be achieved with the help of cylindrical coverings.

The filaments are subsequently cooled off to temperatures below their solidification temperature. In accordance with the invention, "solidification temperature" means that temperature at which the melt makes a transition to the condition of a solid aggregate.

In the framework of the present invention, it has proven to be particularly suitable to cool off the filaments to a temperature at which they are essentially not sticky any longer. A cooling off of the filaments to temperatures below their crystallization temperature, particularly to temperatures below their glass temperature, is particularly advantageous.

Means for cooling off the filaments are known to those of skill in the art. In accordance with the invention, the use of cool gases, particularly cooled air, have particularly proven valuable. The cooling air preferably has a temperature from 12° C. to 35° C., particularly from 16° C. to 26° C. The speed of the cooling air advantageously lies within the range from 0.20 m/sec to 0.55 m/sec.

Individual thread systems, which consist of individual cooling tubes with perforated partition walls, for example, can be used for cooling off the filaments. Cooling of each individual filament is achieved by active supplying of cooling air, or also by using the self-suctioning effect of the filaments. As an alternative to individual tubes, known systems that involve cross-flow quenching can also be used.

One particular configuration of the cooling and extension area comprises supplying the filaments exiting from the quench delay zone with cooling air in a zone with a length in the range from 10 to 175 cm, preferably in a zone with a length in the range of 10 to 80 cm. For filaments with a titer upon spooling of ≦1.5 dtex per filament, a length of zone in the range from 10 to 40 cm is suitable, and a length of zone in the range from 20 to 80 cm is particularly well suited for filaments with a titer between 1.5 and 9.0 dtex per filament. Subsequently, the filaments and the air accompanying them are guided in common through a reduced cross-section tube, whereby the ratio of the air speed to the thread speed of 0.2 to 20:1, preferably 0.4 to 5:1, is set during the drawing-off by controlling the cross-sectional reduction and the dimensioning of the tube in the direction of the running thread.

After cooling off the filaments to temperatures below the solidification temperature, they are bundled into a thread. The distance of the bundling from the lower side of the spinneret plate used in accordance with the invention can be determined by methods that are known in the art for on-line measurement of the speed and/or the temperature of the thread, such as, for example, by means of a laser/doppler anemometer from the firm TSI/Germany, or an infrared camera from the manufacturer Goratec/Germany, type IRRIS 160. This amounts to 500 to 2500 mm, preferably 500 to 1800 mm. Filaments with a titer of ≦3.5 dtex are thereby preferably bundled at a small distance of ≦1500 mm, while thicker filaments are preferably bundled at a greater distance.

In the framework of the present invention, it is suitable that all surfaces that come into contact with the spun filament are preferably manufactured from particularly low-friction materials. By this means and in this manner, formation of broken filaments can be thoroughly avoided, so that higher-valued threads are obtained. Low-friction surfaces of the specification "TriboFil" from the firm Ceramtec/Germany have proven particularly well suited for this purpose.

The bundling of the filaments is carried out in an oiling unit that supplies the desired quantity of spinning preparation to the thread. One particularly suitable oiling unit is characterized by an intake part, a thread channel with an oil entrance aperture, and a discharge part. The intake part is expanded in a funnel shape so that contact with the filaments, which are still dry, is prevented. The contacting point of the filaments lies inside the thread channel behind the inflow feed for the preparation. The width of the thread channel and oil inlet aperture are adjusted to the thread titer and the number of filaments. Apertures and widths in the range of 1.0 mm to 4.0 mm have particularly proven valuable. The discharge part of the oiling device is designed as a blending segment which preferably has oil reservoirs. Such types of oiling devices can be purchased from the firm Cermatec/Germany, or Goulston/USA, for example.

Uniformity of the application of oil can, in accordance with the invention, be of great importance. This can, for example, be determined by means of a Rossa measuring device in accordance with the method described in Chemical Fibers/Textile Industry, 42/94, November 1992, on page 896. Preferably, in such a process, values for the standard deviation of the oil application of less than 90 units, and particularly of less than 60 units, are obtained. Values for the standard deviation of the oil application of less than 45 units, particularly of less than 30 units, are particularly preferred in accordance with the invention. A standard deviation of 90 units or 45 units, respectively, corresponds to approximately 6.2% or 3.1%, respectively, of the coefficient of variation.

In the framework of the present invention, it has proven to be particularly advantageous to design spin-finish lines and pumps for the prevention of gas bubbles in a self-degassing manner, since these can lead to a considerable oscillation of the oil application.

In accordance with the invention, entangling before the spooling of the thread is particularly preferred. In this, nozzles with closed thread channels have proven to be particularly well suited, since hookings of the thread in the insertion slot are avoided in such systems, even with low thread tension and high air pressure. The entangling nozzles are preferably positioned between galettes, whereby the discharge tension of the thread is regulated by means of different speeds of the intake- and discharge galette. This should not exceed 0.20 cN/dtex, but primarily have values between 0.05 cN/dtex and 0.15 cN/dtex. The air pressure of the entangling air thereby lies between 0.5 and 5.5 bar at spooling speeds up to 3500 m/min. at a maximum of 3.0 bar.

Preferably, node numbers of at least 10 n/m are set. In this, maximum aperture lengths of less than 100 cm and values of the variation coefficients of the node number of below 100% are of particular interest. Upon the use of air pressures above 1.0 bar, node numbers of ≧15 n/m, which are characterized by a high uniformity, are advantageously achieved, whereby the coefficient of variation is less than or equal to 70%, and the maximum length of aperture amounts to 50 cm. In actual practice, systems of the type LD from the firm Temco/Germany, the double system from the firm Slack & Parr/USA, or nozzles of the type Polyjet from the firm Heberlein, have proven to be particularly well suited.

The circumferential speed of the first galette is termed the draw-off speed. Additional galette systems can be applied before the thread is, within the winder unit, spooled on tubes to form the bobbins.

Stable, error-free bobbins are an essential presupposition for error-free removal of the thread, as well as for a further processing that is as free of errors as possible. Thus, in the framework of the present process, spooling tension of the thread in the range from 0.025 cN/dtex to 0.15 cN/dtex, preferably in the range of 0.03 cN/dtex to 0.08 cN/dtex, is applied.

One important parameter of the process in accordance with the invention is the adjustment of the thread tension in front of and between the draw-off galettes. This tension is, as is known, essentially composed of the actual orientation tension in accordance with Hamana, the frictional stress on the thread guides and the oiling device, and the thread/air friction stress. Within the framework of the present invention, the tension of the thread in front of and between the draw-off galettes lies in the range from 0.05 cN/dtex to 0.20 cN/dtex, preferably between 0.08 cN/dtex and 0.15 cN/dtex.

Inadequate tension (less than 0.05 cN/dtex) no longer yields the desired level of preorientation. If the tension exceeds 0.20 cN/dtex, a memory effect upon the spooling and the storage of the spools is triggered, leading to worsening of the characteristic values of the thread.

In accordance with the invention, the tension is controlled through the distance of the oiling device from the spinneret plate, and the friction surfaces, and the distance between the oiling device and the first draw-off galette. This distance advantageously is to not more than 6.0 m, preferably less than 2.0 m, whereby the spinning machine and the draw-off machine are positioned, by means of parallel construction, in such a manner that a straight course of the threads is guaranteed.

The conditioning time of the thread between the bundling point and spooling are described by means of the geometrical parameters. The relaxation that is proceeding rapidly during this time influences the quality of the bobbin shape.

The conditioning time, as defined in such manner, is preferably selected between 50 and 200 ms.

The spooling speed of the POY is, in accordance with the invention, between 2200 m/min. and 3500 m/min.

In an advantageous manner, during the carrying out of the process in accordance with the invention, a temperature of ≦45° C., particularly between 12 and 35° C., and a relative humidity of 40 to 85%, are set in the vicinity of the bobbin. The storage of the POY until further processing preferably takes place at a temperature of ≦45° C. Furthermore, it is suitable to store the POY spools for at least 4 hours at 12 to 35° C., and a relative humidity of 40 to 85%, before further processing.

After 4 weeks of storage under normal conditions, the filament in accordance with the invention has:

a) An elongation at break of between 90 and 165%, preferably between 90 and 135%;

b) A boiling-water shrinkage of at least 30%, preferably ≧40%;

c) A normal uster below 1.1%, preferably less than 0.9%;

d) A birefringence of between 0.030 and 0.058;

e) A density of less than 1.35 g/cm$^3$, preferably less than 1.33 g/cm$^3$;

f) A coefficient of variation of the maximum tensile strength of ≦4.5%, preferably ≦2.5%; and g) A coefficient of variation of the elongation at break of ≦4.5%, preferably ≦2.5%.

The term "normal conditions" is known to those skilled in the art and is defined by the norm DIN 53802. At "normal conditions" in accordance with DIN 53802, the temperature is 20±2° C. and the relative humidity is 65±2%.

In the framework of the present invention, it is additionally advantageous that the boiling-water shrinkage is, when measured immediately after the spooling, between 50 and 65% and, after 4 weeks of storage at normal conditions, at least 30%, preferably ≧40%. It has been shown, surprisingly, that POY bobbins produced in such a manner can be further processed in an outstanding manner.

It is to be considered in this connection that, in actual practice, normal climatic conditions can not always be maintained in the production, the storage, or the transport of the POY. With a slightly crystalline thread, the problem frequently appears that the POY bobbins are changed in shape, the stretching ratio and/or the texturing speed must be reduced, and breaks repeatedly appear during the further processing. Threads that maintain the boiling-water shrinkage specifications stated above have such problems relative to conventional threads to a lesser extent.

Furthermore, it has been shown that preferred threads of the present invention after a storage time of 2 months did not have a change in dyeability of the DTY. After a storage time of 20 months, the color change lies within 95±3%, as long as the ambient temperature is not higher than 45° C.

In addition, preferred filaments have a natural stretching ratio of greater than or equal to 15%. In a particularly preferable embodiment, this value is in the range of 18 to 65%. The higher the natural stretching ratio, the better the stretchability. With an equal elongation at break, a higher stretching ratio is achieved with a high natural stretching ratio.

The natural stretching ratio is defined as the plateau section in percentage of the force/expansion diagram. This value is known and is determined on the tensile tester in one operating process upon the determination of the strength and elongation at break.

Figure 2A:
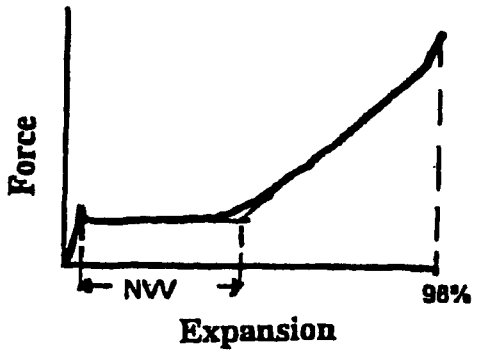
FIG. 2 schematically presents force/expansion diagrams of PTMT-POY. With equal elongation at break, FIG. 2-(*a*) depicts a diagram in accordance with the invention with a natural stretching ratio (NVV) greater than or equal to 15%, and FIG. 2-(*b*) depicts a diagram with NVV=0%.
Figure 2B:
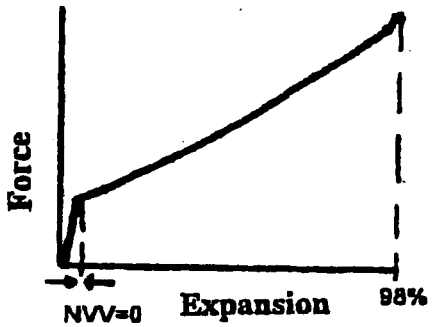

FIGS. 2-(*a*) and 2-(*b*) schematically depict the stated characteristic data of the natural stretching ratio (NVV), whereby the natural stretching ratio in FIG. 2-(*b*) is zero. The force is applied against the expansion in the diagrams, whereby schematic diagrams are presented in order to explain the characteristic data in detail.

It is assumed that the natural stretching ratio is a measure of the thread orientation, and a value NVV<15% describes the incipient crystallization of the polyester. Lower NVV values are obtained, for example, by thermal treatment of the thread up to spooling at temperatures that are at least 8° C. above the glass temperature of the PES.

Processes for the determination of the material characteristic numbers stated are known and routinely determinable by those skilled in the art. They can be derived from the technical literature. Although most parameters can be determined in different ways, the following methods have, within the framework of the present invention, proven to be particularly suitable for the determination of the characteristic numbers of the filament.

The intrinsic viscosity is measured at 25° C. in the capillary viscometer from the firm Ubbelohde, and computed in accordance with a known formula. A mixture of phenol/1,2-dichlorobenzol is used as a solvent in the weight ratio of 3:2. The concentration of the solution amounts to 0.5 g polyester to 100 ml of solution.

A DSC calorimeter from the firm Mettler is used for the determination of the melting point and for the temperature of crystallization and glass. In this, the sample is first heated up to 280° C. and melted, and then suddenly chilled. The DSC measurement is carried out in the range from 20° C. to 280° C., with a heat rate of 10 K/min. The temperature values are determined by the processor.

The determination of the density of the filaments is carried out in a density/gradient column at a temperature of 23±0.1° C. For reagents, n-heptane ($C_7H_{16}$) and tetrachloromethane ($CCl_4$) are used. The result of the density measurement can be used for the computation of the degree of crystallization since the density of the amorphous polyester $D_a$ and the density of the crystalline polyester $D_k$ are taken as the basis. The corresponding computation is known in the art; for example, the following is valid for PTMT: $D_a$=1.295 g/cm$^3$ and $D_k$=1.429 g/cm$^3$.

Titer is determined in the known manner by means of a precision reeling machine and a weighing device. The pre-stressing thereby suitably amounts to 0.05 cN/dtex for preoriented filaments (POY's), and to 0.2 cN/dtex for textured thread (DTY).

Tenacity at break and elongation at break are determined in a Statimat tensile tester with the following conditions: the clamping length is 200 mm for POY or 500 mm for DTY, respectively; the measuring speed is 2000 mm/min. for POY or 1500 mm/min. for DTY, respectively; and the prestressing is 0.05 cN/dtex for POY or 0.2 cN/dtex for DTY, respectively. Tenacity at break is determined by dividing the values for the maximum tensile strength by the titer, and the elongation at break is evaluated at the maximum strength.

To determine boiling-water shrinkage, strands of threads are treated, in a tension-free manner, in water at 95±1° C. for 10±1 min. The strands are produced by means of a reeling machine with a prestressing of 0.05 cN/dtex for POY or of 0.2 cN/dtex for DTY; the measurement of the length of the strands before and after the temperature treatment is carried out at 0.2 cN/dtex. The boiling-water shrinkage is computed in the known manner from the differences in lengths.

Determination of birefringence is carried out in accordance with the procedure described in DE 19 519 898. Reference is thus explicitly made in this connection to the disclosure of DE 19 519 898.

Characteristic bulk values of the textured threads are measured, in accordance with DIN 53840, Part 1, by means of the Texturmat device from the firm Stein/Germany, at the development temperature of 120° C.

The normal uster values are determined with the 4-CX Uster Tester and stated as uster % values. At a test speed of 100 m/min., the test time for this amounts to 2.5 min.

The POY in accordance with the invention can be further processed in a simple way, such as, in particular, stretch-textured. Within the framework of the present invention, stretch texturing is preferably carried out at a texturing speed of at least 500 m/min., and particularly preferably at a texturing speed of at least 700 m/min. The stretching ratio is preferably at least 1:1.35, and particularly at least 1:1.40. Stretch texturing on a machine of the high-temperature heater type, such as the AFK from the firm Barmag, for example, has proven to be particularly suitable.

The bulky threads produced in such a manner have a low number of broken filaments and, after dyeing under processing conditions at 95° C. with a dispersion colorant (Terasil marine blue) without carrier, have an excellent depth of color and uniformity of color.

Bulky SET filaments produced in accordance with the invention preferably have a tenacity at break of more than 26 cN/tex, and an elongation at break of more than 36%. In bulky HE filaments, which can be obtained without temperature application in a second heater, the tenacity at break preferably is more than 26 cN/tex, and the elongation at break more than 30%.

The behavior of bulkiness and elasticity of the filaments in accordance with the invention is outstanding.

The invention will be illustrated in the following by means of examples, without the invention having to be restricted to these examples.

EXAMPLES 1 TO 2

Spinning and Spooling

PTMT chips with an intrinsic viscosity of 0.93 dl/g, a melt viscosity of 325 Pa s (measured at 2.4 Hz and 255° C.), a melting point of 227° C., a crystallization temperature of 72° C., and a glass transition temperature of 45° C., were dried in a tumble dryer at a temperature of 130° C. to a water content of 11 ppm. The chips were melted in a 3E4 extruder from the firm Barmag, so that the temperature of the melt amounted to 255° C. It was then conveyed to the spinning pump through a product line, which contained a static mixer from the firm Sulzer, type SMX, with 15 elements and an internal diameter of 15 mm. The quantity of melt that was transported amounted to 63 g/min. with a residence time of 6 min., and the quantity dosed by the spinning pump to the spin pack assembly amounted to 30.7 g/min. An element of a static mixer, type HD-CSE from the firm Fluitec, with an internal diameter of 10 mm, was installed after the spinning pump and before the entrance into the spin pack assembly. The associated heating units of the product line and spinning beam, which contained the pump and the spin pack assembly, were set at 255° C. The spin pack assembly contained the filter media steel sand of the grain size 350 to 500 μm at a level of 30 mm, as well as a 20 μm non-woven filter and a 40 μm screen filter. The melt was extruded through a spinning plate 80 mm in diameter, with 34 holes 0.25 mm in diameter and a length of 1.0 mm. The spin pack pressure amounted to approximately 120 bar.

The cooling delay zone had a length of 100 mm, whereby 30 mm were a heated partition wall, and 70 mm were insulation and unheated framework. Subsequently to that, the melt threads were cooled off in a quench duct with a cross flow current blowing with a blowing length of 1500 mm. The cooling air had a speed of 0.35 m/sec., a temperature of 18° C., and a relative humidity of 80%. The solidification point of the filaments lay at a distance approximately 800 mm below the spinning plate.

The threads were provided with spinning preparation and bundled with the help of a thread oiling device at a distance of 1050 mm from the spinning plate. The oiling device was provided with a TriboFil surface and had a channel width of 1 mm. The quantity of preparation applied amounted to 0.40% relative to the weight of the thread.

The bundled thread was then conveyed to the spooling machine. The distance between the oiling device and the first draw-off galette amounted to 3.2 m. The conditioning time amounted, depending on the speed, to 144 and 168 ms. A pair of galettes was looped around by the thread in an S-shaped manner. A Temco entangling nozzle, which was operated at an air pressure of 1.5 bar, was installed between the galettes. Corresponding to the adjustment of the speed, the spooling speed of the winding device of the type SW6 from the firm Barmag was set in such a manner that the spooling tension of the thread amounted to 5 cN. The room climate was set at 24° C. at 60% relative humidity, so that a temperature of approximately 34° C. was set in the vicinity of the thread bobbin.

Within the framework of the present experiments, the draw-off speed amounted to either 2940 m/min. (Example 1) or 2506 m/min. (Example 2). Table 1 reproduces the additional experimental parameters, while Table 2 presents the materials characteristics of the preoriented filaments (POY's) that were obtained. Spool weights of 10 kg could be produced with both settings, and could be removed from the winder chuck of the winding device without problems.

TABLE 1

Experimental parameters

| Experimental parameters | | Example 1: | Example 2: |
|---|---|---|---|
| Draw-off speed | [m/min] | 2940 | 2506 |
| Spooling speed | [m/min] | 2926 | 2500 |
| Spinline extension ratio | | 178 | 152 |
| Thread tensions- | | | |
| In front of galettes (1) | [cN] | 14 | 10 |
| Between galettes (1) - max. | [cN] | 11 | 7.5 |
| In front of galettes (2) | [cN/dtex] | 0.13 | 0.08 |
| Between galettes (2) - max. | [cN/dtex] | 0.10 | 0.06 |
| Spooling tension of the thread (1) | [cN] | 5.0 | 5.0 |
| Spooling tension of the thread (2) | [cN/dtex] | 0.048 | 0.041 |

(1) Absolute.
(2) Relative to the titer.

TABLE 2

Materials characteristics of the preoriented PTMT filaments (1)

| Materials characteristics: | | Example 1: | Example 2: |
|---|---|---|---|
| Titer | [dtex] | 105 | 123 |
| Tenacity at break | [cN/tex] | 23.4 | 20.7 |
| Elongation at break | [%] | 98 | 127 |
| Normal uster | [%] | 0.9 | 0.76 |
| Boiling-water shrinkage | [%] | 46 | 33 |
| Birefringence C $10^3$ | Δn | 52 | 43 |
| Density | [g/cm$^3$] | 1.320 | 1.318 |
| CV - maximum tensile strength | [%] | 2.2 | 1.9 |
| CV - elongation at break | [%] | 2.2 | 1.9 |

CV: Coefficient of variation.
(1) Measured after 4 weeks of storage at normal conditions.

Stretch Texturing:

The PTMT filament bobbins were stored in normal climate for four weeks in accordance with DIN 53802, and then submitted to a stretch texturing machine from the firm Barmag, type FK6-S-900. The test parameters of the stretch texturing for the production of so-called SET filaments are summarized in Table 3, while the materials characteristics of the resulting bulky SET filaments are summarized in Table 4.

The texturing errors were determined by means of the UNITENS from the firm Barmag, with the following adjustments of range finding data:

UP/LP=3.0 cN;

UM/LM=6.0 cN.

TABLE 3

Test parameters of stretch texturing

| Test parameters | | Example 1: | Example 2: |
|---|---|---|---|
| Speed | [m/min.] | 700 | 700 |
| Stretching ratio | | 1:1.48 | 1:1.65 |
| D/Y ratio | | 2.1 | 2.1 |
| Temp[erature] - Heater 1 | [° C.] | 155 | 155 |
| Temp[erature] - Heater 2 | [° C.] | 160 | 160 |
| Texturing errors | [n/10 km] | 0 | 0 |
| Tension of the thread | | | |
| $F^1$, in front of false-twist unit | [cN] | 20 | 20 |
| $F^2$, behind the false-twist unit | [cN] | 19 | 18 |
| $F^2$-CV | [%] | 1.2 | 1.3 |

$F^2$-CV: Coefficient of variation of $F^2$.

TABLE 4

Materials characteristics of the stretch-textured filaments

| Materials characteristics: | | Example 1: | Example 2: |
|---|---|---|---|
| Titer | [dtex] | 78 | 82 |
| Tenacity at break | [cN/tex] | 27.7 | 29.0 |
| Elongation at break | [%] | 39.4 | 39.9 |
| Visual dyeability evaluation | | Uniform | Uniform |
| Bulk stability | [%] | 85 | 87 |
| Bulkiness | [%] | 24.5 | 25 |

The bulk behavior can be varied by means of a cold procedure of the 2nd heater; that is to say, through the production of so-called HE-filaments. The bulkiness is then increased to approximately 47%. The elongation at break then dropped to 33%.

We claim:

1. In a process for producing and spooling preoriented polyester flaments comprising at least 90 weight % (relative to the total weight of the polyester filaments) polybutylene terephthalate (PBT) and/or polytrimethylene terephthalate (PTMT) the improvement comprising:

a) setting the spinline extension ratio in the range of 70 to 500;

b) passing the filaments through a cooling delay zone of from 30 mm to 200 mm in length immediately after exiting from the spinning nozzles;

c) cooling the filaments to below the PBT or PTMT solidification temperature;

d) bundling the filaments into thread at a distance of between 500 mm and 2500 mm from the spinneret plate;

e) setting the thread tension in front of and between draw-off galeftes to between 0.05 cN/dtex to 0.20 cN/dtex;

f) spooling the thread with a thread tension of between 0.025 cN/dtex to 0.15 cN/dtex;

g) adjusting the spooling speed to between 2200 m/mm. and 3500 m/mm.

2. The process according to claim 1, wherein the PBT and PTMT are used with an intrinsic viscosity in the range from 0.7 dl/g to 0.95 dl/g.

3. The process according to claim 1, wherein the temperature in the vicinity of the thread coil is set to ≦45° C. during the spooling.

4. The process according to claim 1, further comprising storing the spooled thread for at least 4 hours at 12 to 35° C. and at 40 to 85% relative humidity.

5. Preoriented polyester filaments comprising at least 90 weight % (relative to the total weight of the polyester filaments) polybutylene terephthalate (PBT) and/or polytrimethylene terephthalate (PTMT), wherein after 4 weeks of storage under normal conditions in accordance with DIN 53802 the filaments have the following properties:

a) an elongation at break of between 90 and 165%;

b) a boiling-water shrinkage of at least 30%;

c) a normal uster below 1.1%;

d) a birefringence between 0.030 and 0.058;

e) a density less than 1.35 g/cm$^3$;

f) a coefficient of variation of the maximum tensile strength of ≦4.5%; and g) a coefficient of variation of the elongation at break of 4.5%.

6. A process for the production of bulky polyester filaments, the process comprising processing the filaments of claim 5 into bulky threads in a stretch texturing machine at a speed of at least 500 m/mm. and a stretching ratio of at least 1:1.35.

7. Bulky polyester SET filaments having a tenacity at break is >26 cN/tex and an elongation at break is >36%.

8. Bulky polyester HE filament having a tenacity at break of more than 26 cN/tex and an elongation at break of more than 30%.

9. The process according to claim 1 wherein the polyester filaments comprise at least 90 weight % (relative to the total weight of the polyester filaments) polytrimethylene terephthalate (PTMT).

10. The preoriented polyester filaments according to claim 5, wherein the density is less than 1.33 g./cm$^3$.

11. The process according to claim 1 wherein the preoriented polyester filaments comprise at least 90 weight % (relative to the total weight of the polyester filaments) polytrimethylene terephthalate (PTMT).

* * * * *